US008771017B2

(12) United States Patent
Vino, IV et al.

(10) Patent No.: US 8,771,017 B2
(45) Date of Patent: Jul. 8, 2014

(54) GROUND INLAYS FOR CONTACT MODULES OF RECEPTACLE ASSEMBLIES

(71) Applicant: Tyco Electronics Corporation, Berwyn, PA (US)

(72) Inventors: Michael Joseph Vino, IV, Landisville, PA (US); Justin Dennis Pickel, Hummelstown, PA (US); Justin Shane McClellan, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 80 days.

(21) Appl. No.: 13/654,218

(22) Filed: Oct. 17, 2012

(65) Prior Publication Data

US 2014/0106583 A1 Apr. 17, 2014

(51) Int. Cl.
*H01R 13/648* (2006.01)

(52) U.S. Cl.
USPC ..... 439/607.56

(58) Field of Classification Search
USPC ..... 439/108, 607.56, 607.08
See application file for complete search history.

(56) References Cited

U.S. PATENT DOCUMENTS

| | | | | |
|---|---|---|---|---|
| 6,899,566 | B2 * | 5/2005 | Kline et al. | 439/607.56 |
| 7,267,515 | B2 * | 9/2007 | Lappohn | 439/607.07 |
| 7,381,092 | B2 * | 6/2008 | Nakada | 439/607.1 |
| 7,905,751 | B1 | 3/2011 | Davis | |
| 7,976,318 | B2 * | 7/2011 | Fedder et al. | 439/79 |
| 7,988,491 | B2 | 8/2011 | Davis et al. | |
| 8,262,412 | B1 * | 9/2012 | Minnick et al. | 439/607.01 |
| 8,267,721 | B2 * | 9/2012 | Minich | 439/607.05 |
| 8,469,745 | B2 * | 6/2013 | Davis et al. | 439/607.07 |
| 8,579,636 | B2 * | 11/2013 | Davis et al. | 439/65 |
| 8,616,919 | B2 * | 12/2013 | Stoner | 439/607.07 |
| 2003/0022555 | A1 * | 1/2003 | Vicich et al. | 439/608 |

* cited by examiner

*Primary Examiner* — Alexander Gilman

(57) ABSTRACT

A receptacle assembly includes a receptacle housing and a contact module received in the housing. The contact module includes a tray having a cavity defined by inner surfaces of the tray. Ground inlays are received in the cavity along corresponding inner surfaces. The ground inlays have ground slats and ground flanges extending from the ground slats. A frame assembly is received in the cavity of the tray between the ground inlays. The frame assembly is electrically shielded by the ground inlays and has a plurality of receptacle signal contacts arranged in differential pairs carrying differential signals. The ground slats extend along opposite sides of corresponding pairs of the receptacle signal contacts and the ground flanges extend between pairs of the receptacle signal contacts.

20 Claims, 8 Drawing Sheets

GROUND INLAYS FOR CONTACT MODULES OF RECEPTACLE ASSEMBLIES

BACKGROUND OF THE INVENTION

The subject matter herein relates generally to ground inlays for contact modules of receptacle assemblies for use in midplane connector systems.

Some electrical systems, such as network switches and computer servers with switching capability, include receptacle connectors that are oriented orthogonally on opposite sides of a midplane in a cross-connect application. Switch cards may be connected on one side of the midplane and line cards may be connected on the other side of the midplane. The line card and switch card are joined through header connectors that are mounted on opposite sides of the midplane board. Typically, traces are provided on the sides and/or the layers of the midplane board to route the signals between the header connectors. Sometimes the line card and switch card are joined through header connectors that are mounted on the midplane in an orthogonal relation to one another. The connectors include patterns of signal and ground contacts that extend through a pattern of vias in the midplane.

However, conventional orthogonal connectors have experienced certain limitations. For example, it is desirable to increase the density of the signal and ground contacts within the connectors. Heretofore, the contact density has been limited in orthogonal connectors, due to the contact and via patterns. Conventional systems provide the needed 90° rotation within the midplane assembly, such as having each header providing 45° of rotation of the signal paths. In such systems, identical receptacle assemblies are used. However, the routing of the signals through the header connectors and midplane circuit board is complex, expensive and may lead to signal degradation.

Some connector systems avoid the 90° rotation in the midplane assembly by using a receptacle assembly on one side that is oriented 90° with respect to the receptacle assembly on the other side. Such connector systems have encountered problems with contact density and signal integrity. Electrical shielding for receptacle assemblies has proven difficult and expensive to implement.

A need remains for an improved orthogonal midplane connector system that has high contact density and improved signal integrity in differential pair applications.

BRIEF DESCRIPTION OF THE INVENTION

In one embodiment, a receptacle assembly is provided having a receptacle housing and a plurality of contact modules arranged in the housing in a stacked configuration. Each contact module includes a tray having a cavity defined by inner surfaces of the tray. A frame assembly is received in the cavity of the tray. The frame assembly has a dielectric body holding a plurality of receptacle signal contacts arranged in differential pairs carrying differential signals. Ground inlays are received in the cavity between corresponding inner surfaces and the dielectric body of the frame assembly. The ground inlays have a main body including ground slats and ground flanges extending from the ground slats. The ground flanges extend into the dielectric body and are positioned between differential pairs of the receptacle signal contacts.

Optionally, the ground flanges may extend generally perpendicular from the ground slats. The receptacle signal contacts may have edgesides and broadsides with the broadsides being wider than the edgesides. The edgesides may face other receptacle signal contacts. The ground slats may extend along, parallel to and spaced apart from, the broadsides and the ground flanges may extend between edgesides of receptacle signal contacts of adjacent pairs. The tray may be manufactured from plastic. The ground inlays may be on opposite sides of the frame assembly. The ground flanges of the ground inlays on opposite sides of the frame assembly may overlap each other. The receptacle signal contacts may extend along a signal contact plane with the ground flanges extending through the signal contact plane.

In another embodiment, a contact module is provided for a receptacle assembly. The contact module includes a tray having a cavity defined by inner surfaces of the tray. The tray has a mating end and a mounting end. Ground inlays are received in the cavity along corresponding inner surfaces and have grounding beams extending exterior of the cavity beyond the mating end of the tray and grounding posts exterior of the cavity beyond the mounting end of the tray. The ground inlays have ground slats extending between the grounding beams and the grounding posts. The ground inlays having ground flanges extending from the ground slats. A frame assembly is received in the cavity of the tray between the ground inlays. The frame assembly is electrically shielded by the ground inlays and has a plurality of receptacle signal contacts with mating portions extending exterior of the cavity from the mating end of the tray. The receptacle signal contacts are arranged in differential pairs carrying differential signals. The ground slats extend along opposite sides of corresponding pairs of the receptacle signal contacts and the ground flanges extend between pairs of the receptacle signal contacts.

In another embodiment, a receptacle assembly is provided that includes a receptacle housing having a mating end and a contact module received in the housing. The contact module includes a tray having a cavity defined by inner surfaces of the tray. The tray has a mating end and a mounting end. Ground inlays are received in the cavity along corresponding inner surfaces and have grounding beams extending exterior of the cavity beyond the mating end of the tray and grounding posts exterior of the cavity beyond the mounting end of the tray. The ground inlays have ground slats extending between the grounding beams and the grounding posts. The ground inlays having ground flanges extending from the ground slats. A frame assembly is received in the cavity of the tray between the ground inlays. The frame assembly is electrically shielded by the ground inlays and has a plurality of receptacle signal contacts with mating portions extending exterior of the cavity from the mating end of the tray. The receptacle signal contacts are arranged in differential pairs carrying differential signals. The ground slats extend along opposite sides of corresponding pairs of the receptacle signal contacts and the ground flanges extend between pairs of the receptacle signal contacts.

DETAILED DESCRIPTION OF THE INVENTION

Figure 1:
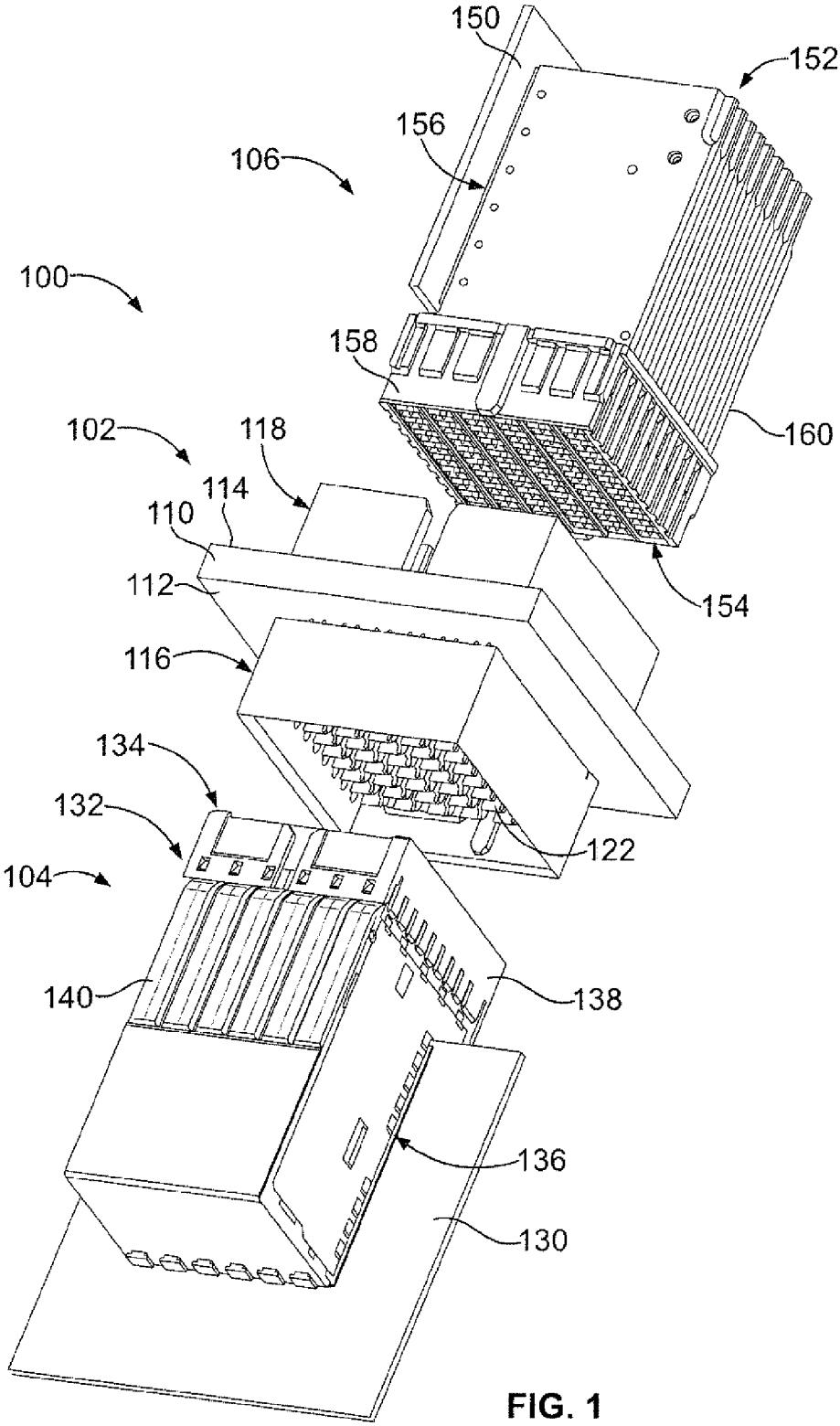
FIG. 1 is a perspective view of a midplane connector system formed in accordance with an exemplary embodiment.

FIG. 1 is a perspective view of a midplane connector system 100 formed in accordance with an exemplary embodiment. The midplane connector system 100 includes a midplane assembly 102, a first connector assembly 104 configured to be coupled to one side of the midplane assembly 102 and a second connector assembly 106 configured to be connected to a second side the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. The first and second connector assemblies 104, 106 may be line cards or switch cards.

The midplane assembly 102 includes a midplane circuit board 110 having a first side 112 and second side 114. The midplane assembly 102 includes a first header assembly 116 mounted to and extending from the first side 112 of the midplane circuit board 110. The midplane assembly 102 includes a second header assembly 118 mounted to and extending from the second side 114 of the midplane circuit board 110. The first and second header assemblies 116, 118 each include header signal contacts 120 (shown in FIG. 2) electrically connected to one another through the midplane circuit board 110.

The first and second header assemblies 116, 118 include header ground shields 122 that provide electrical shielding around corresponding header signal contacts 120. In an exemplary embodiment, the header signal contacts 120 are arranged in pairs configured to convey differential signals. The header ground shields 122 peripherally surround a corresponding pair of the header signal contacts 120. In an exemplary embodiment, the header ground shields 122 are C-shaped, covering three sides of the pair of header signal contacts 120. One side of the header ground shield 122 is open. In the illustrated embodiment, the header ground shields 122 have an open bottom, but the header ground shield 122 below the open bottom provides shielding across the open bottom. Each pair of header signal contacts 120 is therefore surrounded on all four sides thereof using the C-shaped header ground shield 122 and the header ground shield 122 below the pair of header signal contacts 120.

In alternative embodiments, the first and second header assemblies 116, 118 may include contact modules loaded into a housing, similar to the connector assemblies 102, 104. Optionally, the first and second header assemblies 116, 118 may be mounted to cables rather than the midplane circuit board 110.

The first connector assembly 104 includes a first circuit board 130 and a first receptacle assembly 132 coupled to the first circuit board 130. The first receptacle assembly 132 is configured to be coupled to the first header assembly 116. The first receptacle assembly 132 has a header interface 134 configured to be mated with the first header assembly 116. The first receptacle assembly 132 has a board interface 136 configured to be mated with the first circuit board 130. In an exemplary embodiment, the board interface 136 is orientated perpendicular with respect to the header interface 134. When the first receptacle assembly 132 is coupled to the first header assembly 116, the first circuit board 130 is orientated perpendicular with respect to the midplane circuit board 110.

The first receptacle assembly 132 includes a receptacle housing 138 that holds a plurality of contact modules 140. The contact modules 140 are held in a stacked configuration generally parallel to one another. The contact modules 140 hold a plurality of receptacle signal contacts 142 (shown in FIG. 3) that are electrically connected to the first circuit board 130 and define signal paths through the first receptacle assembly 132. The receptacle signal contacts 142 are configured to be electrically connected to the header signal contacts 120 of the first header assembly 116. In an exemplary embodiment, the contact modules 140 provide electrical shielding for the receptacle signal contacts 142. Optionally, the receptacle signal contacts 142 may be arranged in pairs carrying differential signals. In an exemplary embodiment, the contact modules 140 generally provide 360° shielding for each pair of receptacle signal contacts 142 along substantially the entire length of the receptacle signal contacts 142 between the board interface 136 and the header interface 134. The shield structure of the contact modules 140 that provides the electrical shielding for the pairs of receptacle signal contacts 142 is electrically connected to the header ground shields 122 of the first header assembly 116 and is electrically connected to a ground plane of the first circuit board 130.

The second connector assembly 106 includes a second circuit board 150 and a second receptacle assembly 152 coupled to the second circuit board 150. The second receptacle assembly 152 is configured to be coupled to the second header assembly 118. The second receptacle assembly 152 has a header interface 154 configured to be mated with the second header assembly 118. The second receptacle assembly 152 has a board interface 156 configured to be mated with the second circuit board 150. In an exemplary embodiment, the board interface 156 is orientated perpendicular with respect to the header interface 154. When the second receptacle assembly 152 is coupled to the second header assembly 118, the second circuit board 150 is orientated perpendicular with respect to the midplane circuit board 110. The second circuit board 150 is oriented perpendicular to the first circuit board 130.

The second receptacle assembly 152 includes a receptacle housing 158 that holds a plurality of contact modules 160. The contact modules 160 are held in a stacked configuration generally parallel to one another. The contact modules 160 hold a plurality of receptacle signal contacts 162 (shown in FIG. 4) that are electrically connected to the second circuit board 150 and define signal paths through the second receptacle assembly 152. The receptacle signal contacts 162 are configured to be electrically connected to the header signal contacts of the second header assembly 118. In an exemplary embodiment, the contact modules 160 provide electrical shielding for the receptacle signal contacts 162. Optionally, the receptacle signal contacts 162 may be arranged in pairs carrying differential signals. In an exemplary embodiment, the contact modules 160 generally provide 360° shielding for each pair of receptacle signal contacts 162 along substantially the entire length of the receptacle signal contacts 162 between the board interface 156 and the header interface 154. The shield structure of the contact modules 160 that provides the electrical shielding for the pairs of receptacle signal contacts 162 is electrically connected to the header ground shields of the second header assembly 118 and is electrically connected to a ground plane of the second circuit board 150.

In the illustrated embodiment, the first circuit board 130 is oriented generally horizontally. The contact modules 140 of the first receptacle assembly 132 are orientated generally vertically. The second circuit board 150 is oriented generally vertically. The contact modules 160 of the second receptacle assembly 152 are oriented generally horizontally. The first connector assembly 104 and the second connector assembly 106 have an orthogonal orientation with respect to one another. The signal contacts within each differential pair, including the receptacle signal contacts 142 of the first receptacle assembly 132, the receptacle signal contacts 162 of the second receptacle assembly 152, and the header signal contacts 120, are all oriented generally horizontally. Optionally, the first and/or second receptacle assemblies 132, 152 may be mounted to cables rather than the circuit boards 130, 150.

Figure 2:
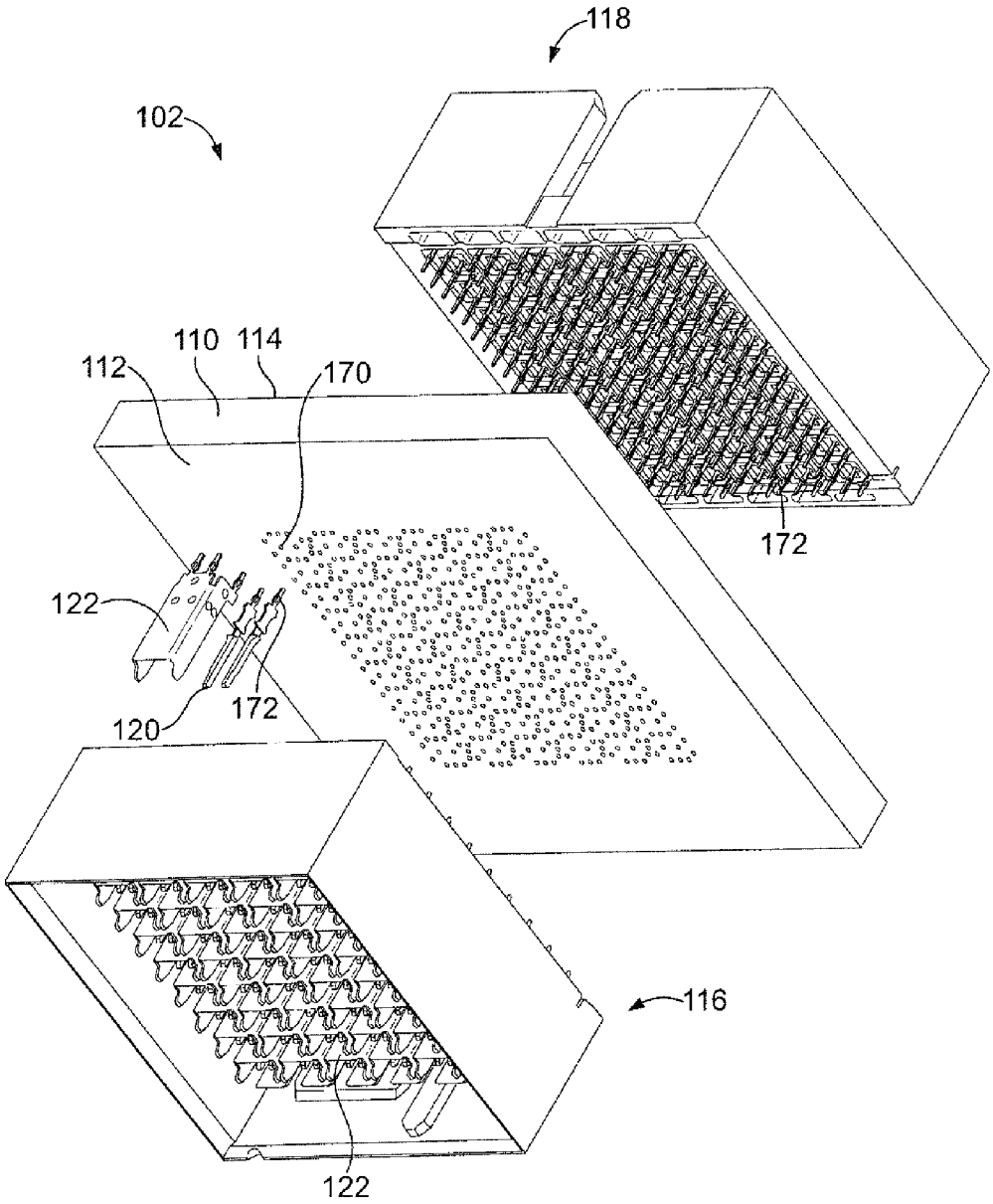
FIG. 2 is an exploded view of a midplane assembly showing first and second header assemblies poised for mounting to a midplane circuit board.

FIG. 2 is an exploded view of the midplane assembly 102 showing the first and second header assemblies 116, 118 poised for mounting to the midplane circuit board 110. Conductive vias 170 extend through the midplane circuit board 110 between the first and second sides 112, 114. The conductive vias 170 receive mounting ends 172 of the header signal contacts 120 of the first and second header assemblies 116, 118, thereby providing an electrical connection between the first and second header assemblies 116, 118. Some of the conductive vias 170 are configured to receive mounting ends of the header ground shields 122. Other configurations or shapes for the header ground shields 122 are possible in alternative embodiments.

Figure 3:
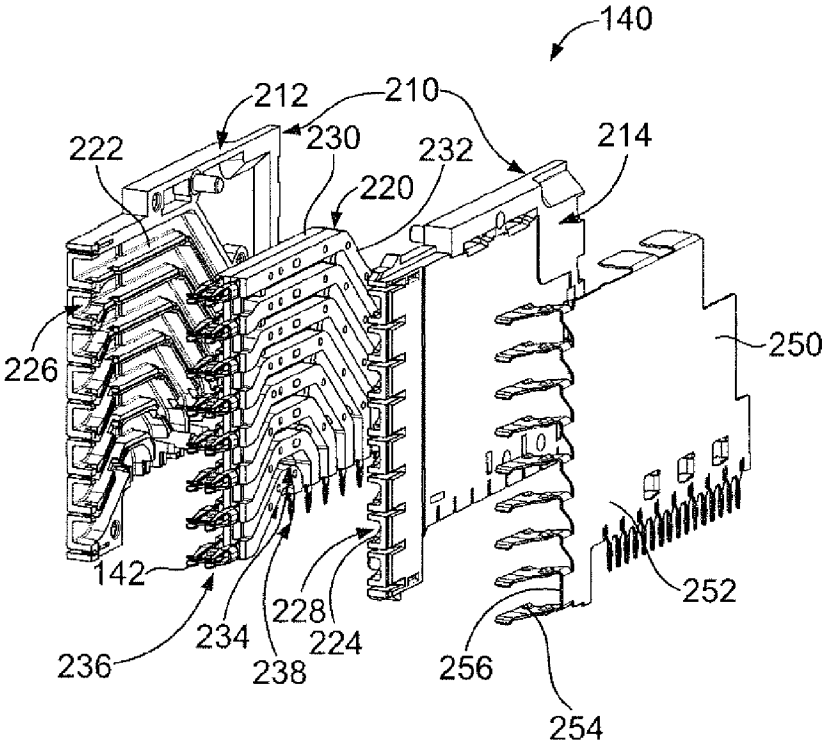
FIG. 3 is a front, exploded perspective view of a first receptacle assembly formed in accordance with an exemplary embodiment.
Figure 3:
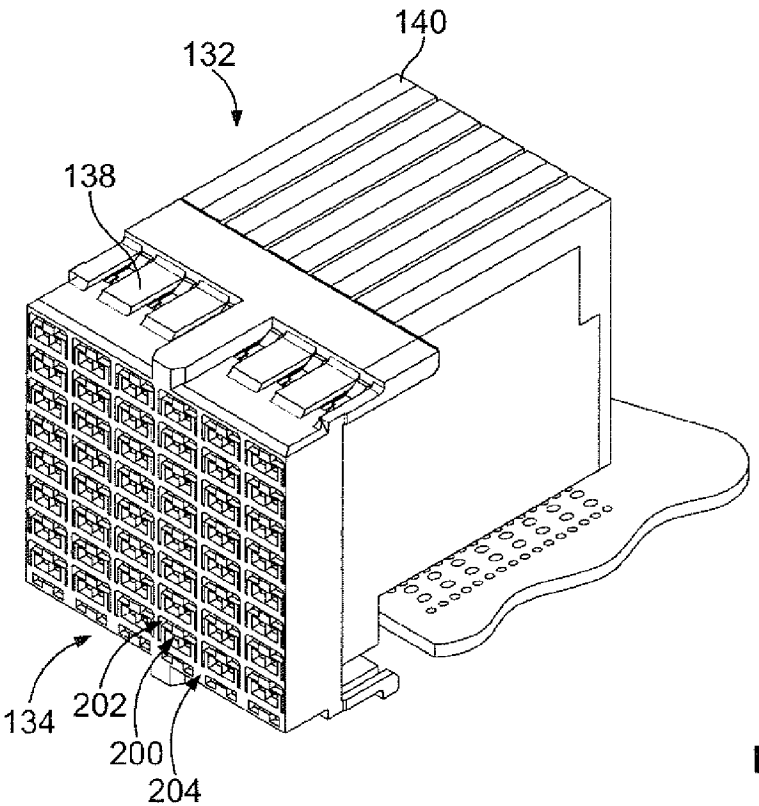

FIG. 3 is a front, exploded perspective view of the first receptacle assembly 132 formed in accordance with an exemplary embodiment. FIG. 3 illustrates one of the contact modules 140 in an exploded state and poised for assembly and loading into the receptacle housing 138. The receptacle housing 138 includes a plurality of signal contact openings 200 and a plurality of ground contacts openings 202 at a mating end 204 of the receptacle housing 138. The mating end 204 defines the header interface 134 of the first receptacle assembly 132.

The contact modules 140 are coupled to the receptacle housing 138 such that the receptacle signal contacts 142 are received in corresponding signal contact openings 200. The signal contact openings 200 may also receive corresponding header signal contacts 120 (shown in FIG. 2) therein when the receptacle and header assemblies 132, 116 are mated. The ground contact openings 202 receive corresponding header ground shields 122 (shown in FIG. 2) therein when the receptacle and header assemblies 132, 116 are mated. The ground contact openings 202 receive grounding members, such as grounding beams of the contact modules 140 that mate with the header ground shields 122 to electrically common the receptacle and header assemblies 132, 116.

The contact module 140 includes a conductive holder 210, which in the illustrated embodiment includes a first holder member 212 and a second holder member 214 that are coupled together to form the holder 210. The holder members 212, 214 are fabricated from a conductive material. For example, the holder members 212, 214 may be die cast from a metal material. Alternatively, the holder members 212, 214 may be stamped and formed or may be fabricated from a plastic material that has been metallized or coated with a metallic layer. By having the holder members 212, 214 fabricated from a conductive material, the holder members 212, 214 may provide electrical shielding for the receptacle signal contacts 142 of the first receptacle assembly 132. The holder members 212, 214 define at least a portion of a shield structure of the first receptacle assembly 132.

The conductive holder 210 holds a frame assembly 220, which includes the receptacle signal contacts 142. The holder members 212, 214 provide shielding around the frame assembly 220 and receptacle signal contacts 142. The holder members 212, 214 include tabs 222, 224 that extend inward toward one another to define discrete channels 226, 228, respectively. The tabs 222, 224 define at least a portion of a shield structure that provides electrical shielding around the receptacle signal contacts 142. The tabs 222, 224 are configured to extend into the frame assembly 220 such that the tabs 222, 224 are positioned between receptacle signal contacts 142 to provide shielding between corresponding receptacle signal contacts 142. In alternative embodiments, one holder member 212 or 214 could have a tab that accommodates the entire frame assembly 220 and the other holder member 212 or 214 acts as a lid.

The frame assembly 220 includes a pair of dielectric frames 230, 232 surrounding the receptacle signal contacts 142. In an exemplary embodiment, the receptacle signal contacts 142 are initially held together as leadframes (not shown), which are overmolded with dielectric material to form the dielectric frames 230, 232. Manufacturing processes other than overmolding a leadframe may be utilized to form the dielectric frames 230, 232, such as loading receptacle signal contacts 142 into a formed dielectric body. The dielectric frames 230, 232 include openings 234 that receive the tabs 222, 224. The tabs 222, 224 are positioned between adjacent receptacle signal contacts 142 to provide shielding between such receptacle signal contacts 142.

The receptacle signal contacts 142 have mating portions 236 extending from the front walls of the dielectric frames 230, 232 and mounting portions 238 extending from the bottom walls of the dielectric frames 230, 232. Other configurations are possible in alternative embodiments.

In an exemplary embodiment, the receptacle signal contacts 142 are arranged as differential pairs. In an exemplary embodiment, one of the receptacle signal contacts 142 of each pair is held by the dielectric frame 230 while the other receptacle signal contact 142 of the differential pair is held by the other dielectric frame 232. The receptacle signal contacts 142 of each pair extend through the frame assembly 220 generally along parallel paths such that the receptacle signal contacts 142 are skewless between the mating portions 236 and the mounting portions 238. Each contact module 140 holds both receptacle signal contacts 142 of each pair. The receptacle signal contacts 142 of the pairs are held in different columns. Each contact module 140 has two columns of receptacle signal contacts 142. One column is defined by the receptacle signal contacts 142 held by the dielectric frame 230 and another column is defined by the receptacle signal contacts 142 held by the dielectric frame 232. The receptacle signal contacts 142 of each pair are arranged in a row extending generally perpendicular with respect to the columns.

In an exemplary embodiment, the contact module 140 includes a ground shield 250 coupled to an exterior side of the conductive holder 210. The ground shield 250 includes a main body 252 that is generally planar and extends alongside of the second holder member 214. The ground shield 250 includes grounding beams 254 extending from a front 256 of the main body 252. The grounding beams 254 are configured to extend into the ground contact openings 202. The grounding beams 254 are configured to engage and be electrically connected to the header ground shields 122 (shown in FIG. 2) when the contact modules 140 are loaded into the receptacle housing 138 and when the first receptacle assembly 132 is coupled to the first header assembly 116.

Figure 4:
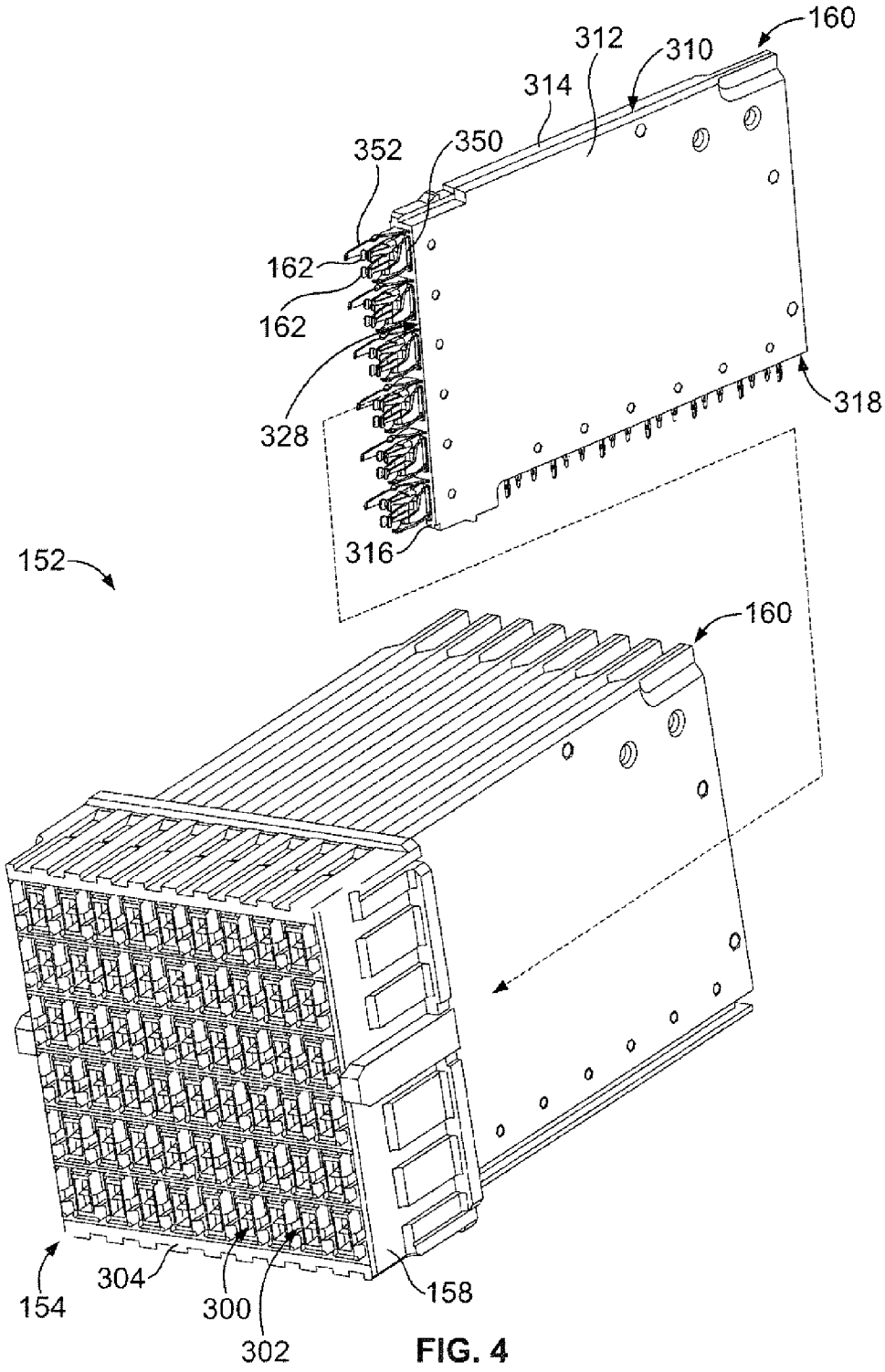
FIG. 4 is a front perspective view of a portion of a second receptacle assembly.

FIG. 4 is a front perspective view of the second receptacle assembly 152 showing one of the contact modules 160 poised for loading into the receptacle housing 158. The receptacle housing 158 includes a plurality of signal contact openings 300 and a plurality of ground contacts openings 302 at a mating end 304 of the receptacle housing 158. The mating end 304 defines the header interface 154 of the second receptacle assembly 152.

The contact modules 160 are coupled to the receptacle housing 158 such that the receptacle signal contacts 162 are received in corresponding signal contact openings 300. The signal contact openings 300 may also receive corresponding header signal contacts 120 (shown in FIG. 2) therein when the receptacle and header assemblies 152, 118 are mated. The ground contact openings 302 receive corresponding header ground shields 122 (shown in FIG. 2) therein when the receptacle and header assemblies 152, 118 are mated. The ground contact openings 302 receive grounding members, such as grounding beams of the contact modules 160, which mate with the header ground shields 122 to electrically common the receptacle and header assemblies 152, 118.

The receptacle housing 158 is manufactured from a dielectric material, such as a plastic material, and provides isolation for the receptacle signal contacts 162 and the header signal contacts 120 from the header ground shields 122. In the illustrated embodiment, the ground contact openings 302 are C-shaped to receive the C-shaped header ground shields 122. Other shapes are possible in alternative embodiments, such as when other shaped header ground shields 122 are used.

The contact module 160 includes a tray 310, which in the illustrated embodiment includes a first holder member 312 and a second holder member 314 that are coupled together to form the tray 310. The tray 310 has a mating end 316 and a mounting end 318. The tray 310 defines the exterior shell of the contact module 160. The tray 310 includes a cavity 328 defined by and/or between the first and second holder members 312, 314. The tray 310 is used to hold the receptacle signal contacts 162 as well as ground inlays 350, 352 that provide electrical shielding for the receptacle signal contacts 162. The ground inlays 350, 352 are received in the cavity 328 to provide shielding for the receptacle signal contacts 162.

The holder members 312, 314 are fabricated from a dielectric material, such as a plastic material. For example, the holder members 312, 314 may be injection molded from a plastic material. In alternative embodiments, the holder members 312, 314 may be conductive, such as being die cast from a metal material, metallized plastic components, stamped and formed components and the like. By having the holder members 312, 314 fabricated from a conductive material, the holder members 312, 314 may provide electrical shielding for the second receptacle assembly 152. However, manufacturing from a dielectric material provides a lower cost holder for the components of the contact module 160, while the use of the ground inlays 350, 352 still provides electrical shielding for the receptacle signal contacts 162.

Figure 5:
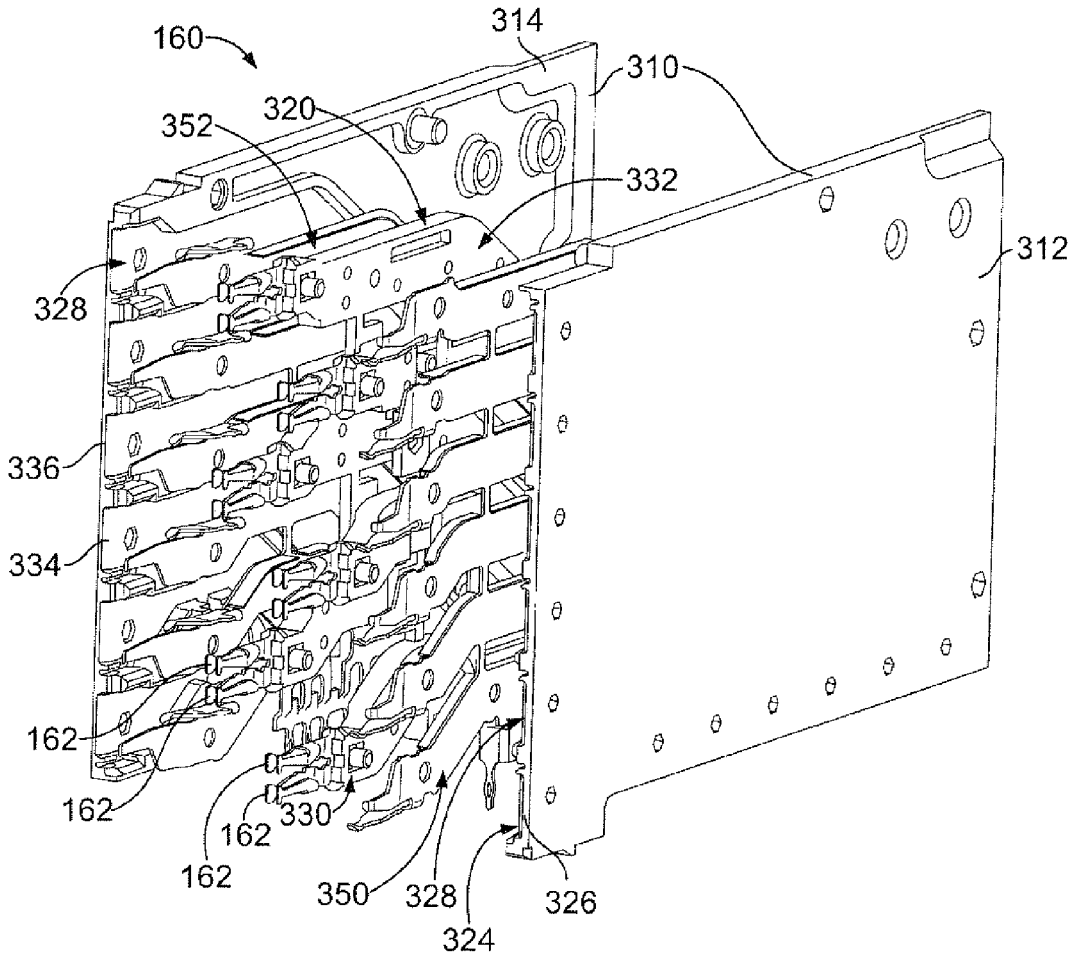
FIG. 5 is an exploded view of a contact module for the second receptacle assembly shown in FIG. 4.

FIG. 5 is an exploded view of the contact module 160. The tray 310 holds a frame assembly 320, which includes the receptacle signal contacts 162. In the illustrated embodiment, the frame assembly 320 includes a first frame 330 and a second frame 332 that are configured to be internested. The first and second frames 330, 332 surround corresponding receptacle signal contacts 162. The first and second frames 330, 332 define a dielectric body that holds the receptacle signal contacts 162. Optionally, the first frame 330 may be manufactured from a dielectric material overmolded over the corresponding receptacle signal contacts 162. The second frame 332 may be manufactured from a dielectric material overmolded over the corresponding receptacle signal contacts 162. Manufacturing processes other than overmolding leadframes may be utilized to form the dielectric frames 330, 332. The first and second frames 330, 332 are coupled together to form the frame assembly 320. The frame assembly 320 is then loaded into the tray 310 and held by the tray 310. Alternatively, the frame assembly 320 may include a single dielectric frame overmolded over a single leadframe.

The first and second ground inlays 350, 352 are configured to be inlaid in the tray 310 on opposite sides of the frame assembly 320 to provide electrical shielding for the receptacle signal contacts 162. The ground inlays 350, 352 make ground terminations to the header ground shields 122 (shown in FIG. 2) and the second circuit board 150 (shown in FIG. 1). In an exemplary embodiment, the ground inlays 350, 352 are internal ground shields positioned within the tray 310. For example, the first ground inlay 350 is laid in the first holder member 312 against an inner surface 324 of a side wall 326 of the first holder member 312. The first ground inlay 350 is positioned between the side wall 326 of the first holder member 312 and the frame assembly 320. The second ground inlay 352 is laid in the second holder member 314 against an inner surface 334 of a side wall 336 of the second holder member 314. The second ground inlay 352 is positioned between the side wall 336 of the second holder member 314 and the frame assembly 320. The inner surfaces 324, 334 of the tray 310 define the cavity 328 therebetween.

Figure 6:
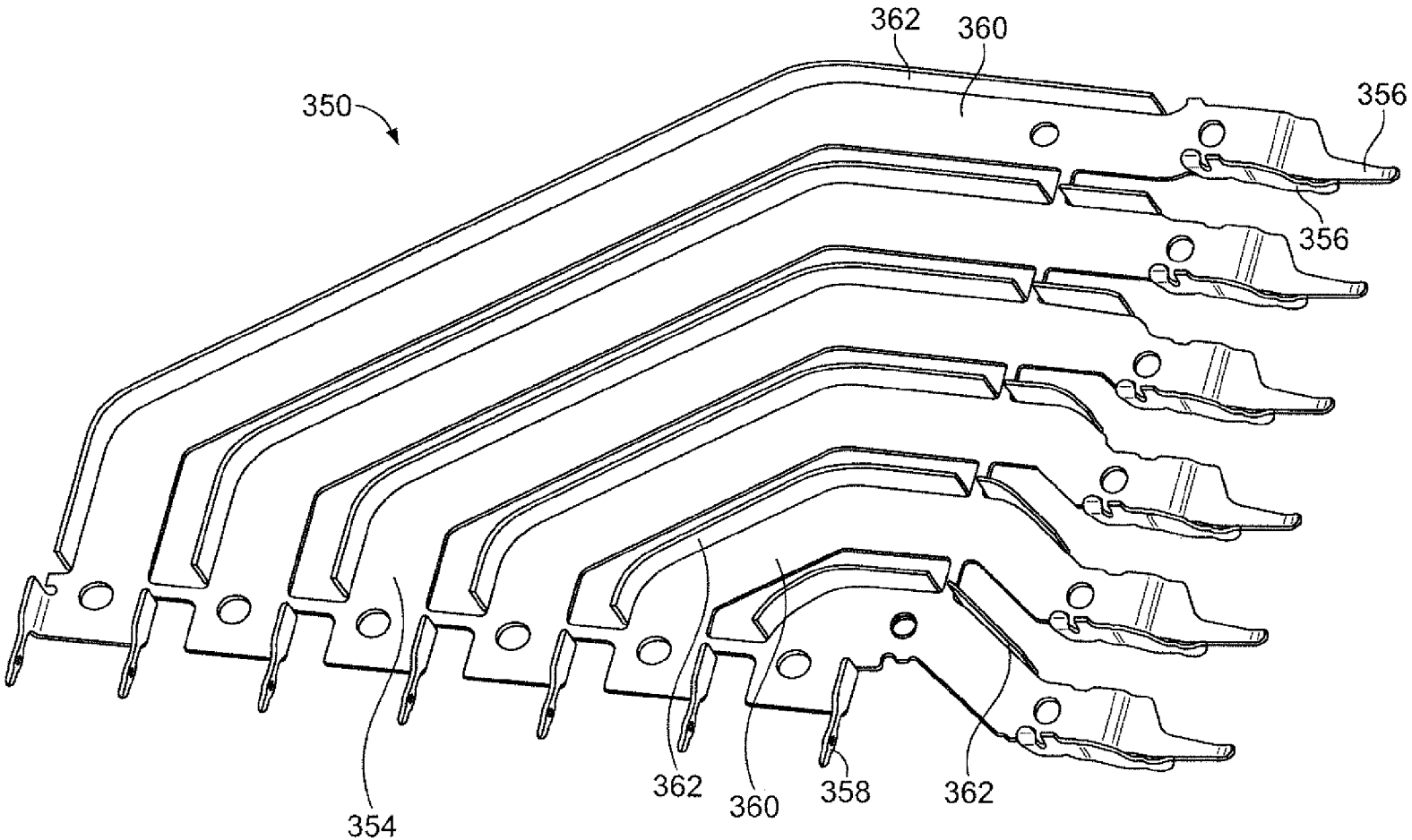
FIG. 6 is a side perspective view of a ground inlay for the contact module shown in FIG. 5.

FIG. 6 is a side perspective view of the first ground inlay 350. The first ground inlay 350 is a stamped and formed structure. The first ground inlay 350 includes a main body 354 with grounding beams 356 extending from a mating end of the first ground inlay 350 and grounding posts 358 extending from a mounting end of the first ground inlay 350. The main body 354 includes a plurality of ground slats 360 extending between the grounding beams 356 and grounding posts 358. The main body 354 includes a plurality of ground flanges 362 extending from corresponding ground slats 360.

The grounding beams 356 are configured to engage a grounded component, such as the header ground shields 122 (shown in FIG. 2), when the receptacle assembly 152 (shown in FIG. 1) is coupled to the header assembly 118 (shown in FIG. 1). The grounding beams 356 extend along the mating portions of the receptacle signal contacts 162 (shown in FIG. 5). Any number of grounding beams 356 may be provided.

The grounding posts 358 are configured to engage a grounded component, such as the second circuit board 150 (shown in FIG. 1). The grounding posts 358 may be compliant pins configured to be received in corresponding conductive vias in the second circuit board 150. Other types of grounding posts 358 may be provided in alternative embodiments, such as surface mounting tails for surface mounting to the second circuit board 150. The grounding posts 358 may include other structures for terminating to other grounded components other than a circuit board, such as crimp barrels for terminating to wires.

The ground slats 360 are separated by windows or spaces. In an exemplary embodiment, the ground flanges 362 are stamped from the main body 354 and formed or bent out of plane, thereby forming the windows between the ground slats 360. The ground flanges 362 extend at an angle with respect to a ground inlay plane defined by the ground slats 360. In an exemplary embodiment, the ground flanges 362 are approximately perpendicular to the ground slats 360.

Figure 7:
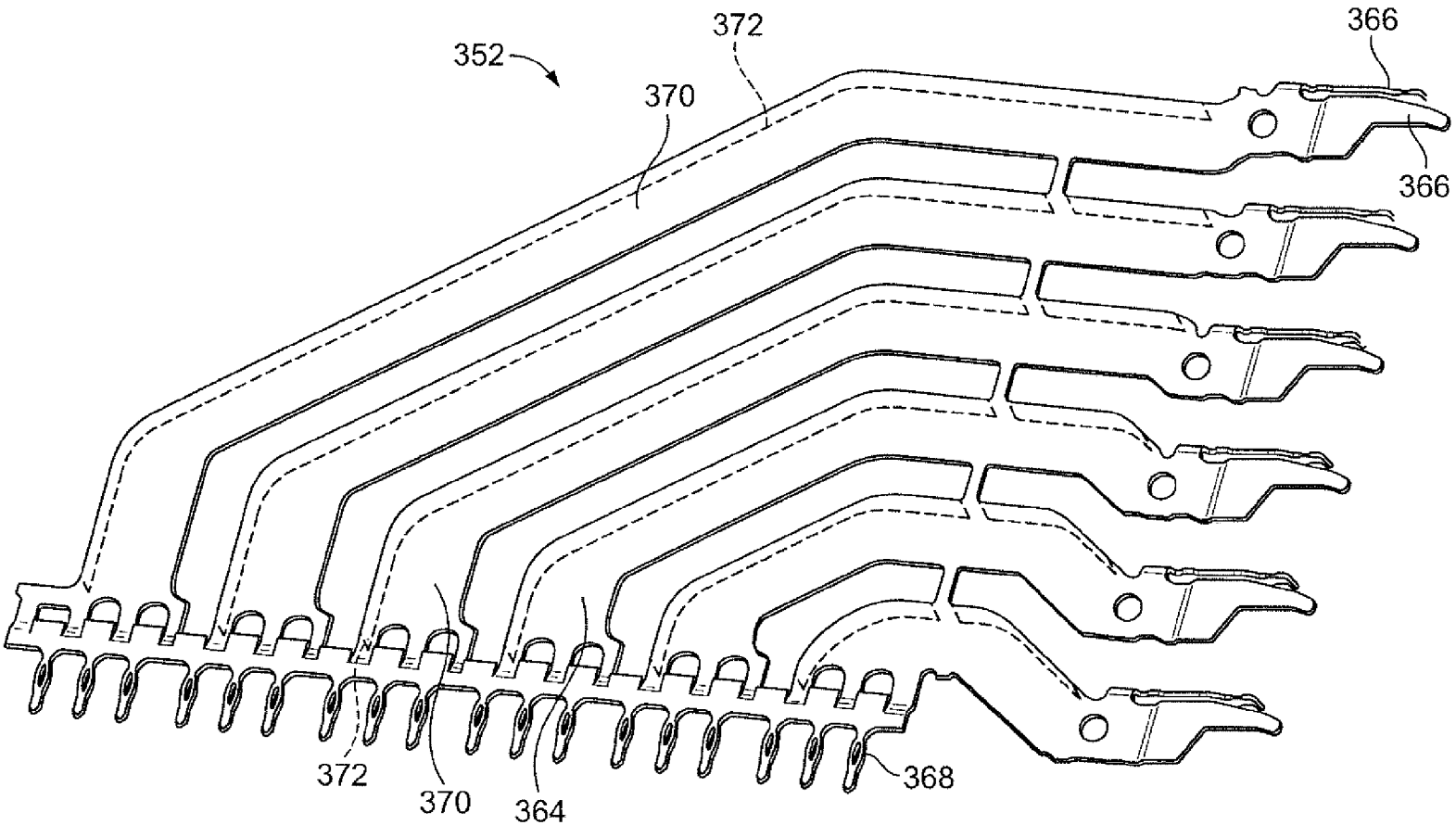
FIG. 7 is a side perspective view of another ground inlay for the contact module shown in FIG. 5.

FIG. 7 is a side perspective view of the second ground inlay 352. The second ground inlay 352 is a stamped and formed structure. The second ground inlay 352 includes a main body 364 with grounding beams 366 extending from a mating end of the second ground inlay 352 and grounding posts 368 extending from a mounting end of the second ground inlay 352. The main body 364 includes a plurality of ground slats 370 extending between the grounding beams 366 and grounding posts 368. The main body 364 includes a plurality of ground flanges 372 extending from corresponding ground slats 370. The ground flanges 372 are illustrated as being bent into the page in FIG. 7 so as to be hidden behind the ground slats 370 and are thus shown in phantom.

The grounding beams 366 are configured to engage a grounded component, such as the header ground shields 122 (shown in FIG. 2), when the receptacle assembly 152 (shown in FIG. 1) is coupled to the header assembly 118 (shown in FIG. 1). The grounding beams 366 extend along the mating portions of the receptacle signal contacts 162 (shown in FIG. 5). Any number of grounding beams 366 may be provided.

The grounding posts 368 are configured to engage a grounded component, such as the second circuit board 150 (shown in FIG. 1). The grounding posts 368 may be compliant pins configured to be received in corresponding conductive vias in the second circuit board 150. Other types of grounding posts 368 may be provided in alternative embodiments, such as surface mounting tails for surface mounting to the second circuit board 150. The grounding posts 368 may include other structures for terminating to other grounded components other than a circuit board, such as crimp barrels for terminating to wires.

The ground slats 370 are separated by windows or spaces. In an exemplary embodiment, the ground flanges 372 are stamped from the main body 364 and formed or bent out of plane, thereby forming the windows between the ground slats 370. The ground flanges 372 extend at an angle with respect to a ground inlay plane defined by the ground slats 370. In an exemplary embodiment, the ground flanges 372 are approximately perpendicular to the ground slats 370.

Figure 8:
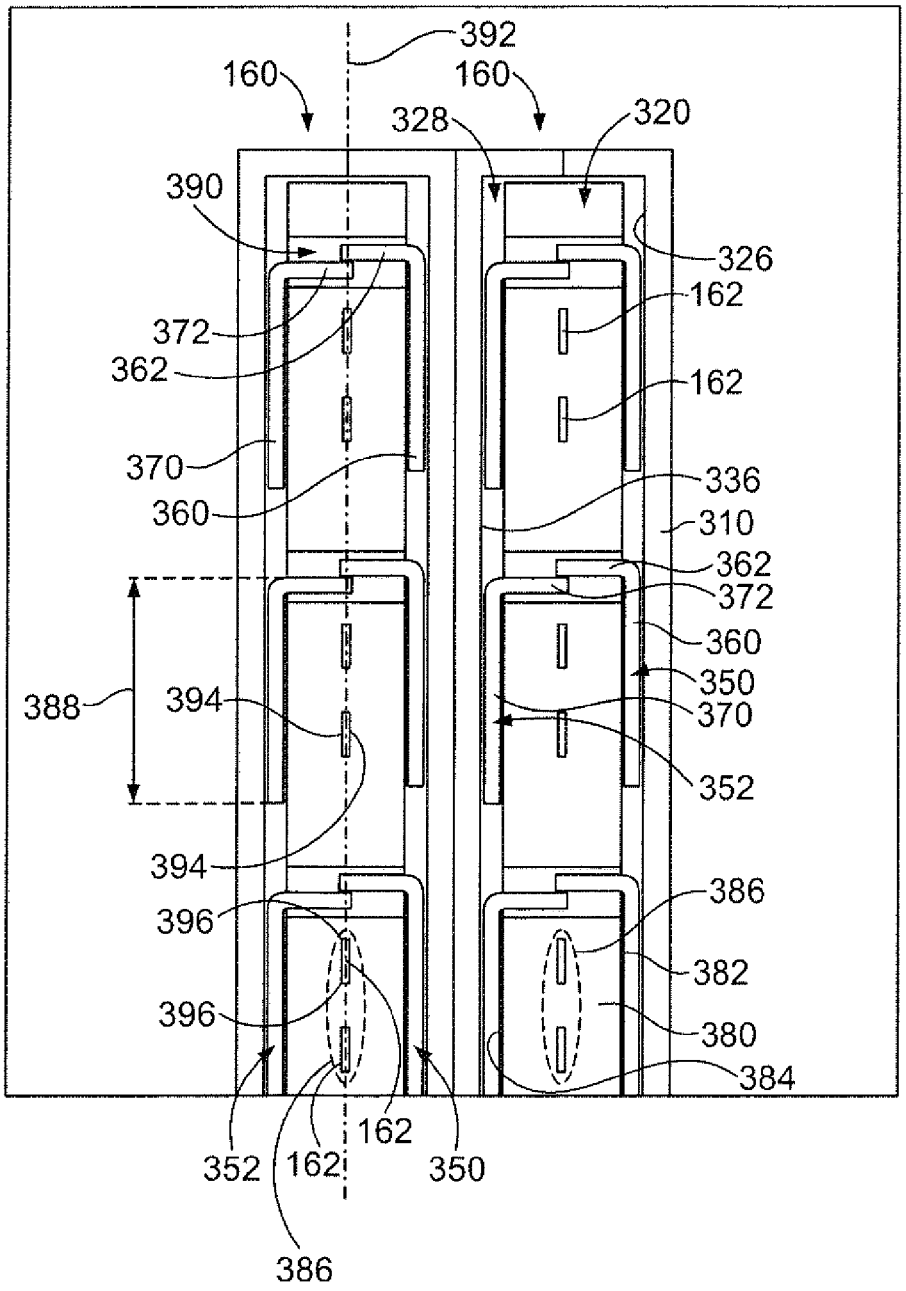
FIG. 8 is a cross-sectional view of a portion of the second receptacle assembly shown in FIG. 4, showing portions of contact modules stacked side-by-side.

FIG. 8 is a cross-sectional view of a portion of the second receptacle assembly 152 (shown in FIG. 1), showing portions of contact modules 160 stacked side-by-side. When each contact module 160 is assembled, the ground inlays 350, 352 are positioned in the tray 310 against the opposite side walls 326, 336 of the tray 310. The frame assembly 320 is positioned in the cavity 328 of the tray 310 between the ground inlays 350, 352. The frame assembly 320 includes a dielectric body 380 defined by the overmolded structure of the first and second frames 330, 332 (shown in FIG. 4). The dielectric body 380 surrounds the receptacle signal contacts 162. The dielectric body 380 has a first side 382 and a second side 384 opposite the first side 382. The first side 382 abuts against the first ground inlay 350. The second side 384 abuts against the second ground inlay 352. The ground inlays 350, 352 provide shielding for the pairs of receptacle signal contacts 162. The dielectric material of the dielectric body 380 is between the receptacle signal contacts 162 and the ground inlays 350, 352.

In an exemplary embodiment, the receptacle signal contacts 162 are arranged in differential pairs 386. The receptacle signal contacts 162 of each pair 386 are part of the same contact module 160 and held by the same dielectric body 380. The pairs 386 are electrically shielded from other pairs 386 by the ground inlays 350, 352. For example, the ground slats 360, 370 extend along opposite sides of corresponding pairs 386 of receptacle signal contacts 162 and provide electrical shielding for pairs 386 in one contact module 160 from pairs 386 in an adjacent contact module 160. The ground slats 360, 370 abut against the first and second sides 382, 384, respectively. The ground slats 360, 370 have a height 388. The ground slats 360, 370 are tall enough to extend at least to, if not beyond, the outer edges of the receptacle signal contacts 162 of the corresponding pair 386 to ensure full coverage of the receptacle signal contacts 162 for electrical shielding thereof. The heights 388 of the ground slats 360 may be different than the heights 388 of the ground slats 370.

The ground flanges 362, 372 extend inward from the ground slats 360, 370. The ground flanges 362, 372 extend into slots 390 formed in the dielectric body 380 such that the ground flanges 362, 372 are interior of the first and second sides 382, 384. The ground flanges 362, 372 extend through a signal contact plane 392 defined by the receptacle signal contacts 162 (e.g. parallel to and approximately centered between the sides 382, 384). In an exemplary embodiment, both ground flanges 362, 372 extend across the signal contact plane 392. The ground flanges 362, 372 overlap at distal ends thereof to ensure that the receptacle signal contacts 162 are completely covered for electrical shielding thereof. Alternatively, the ground flanges 362, 372 may butt against each other rather than overlap. In an exemplary embodiment, the ground flanges 362, 372 engage each other to electrically connect the first and second ground inlays 350, 352. The ground flanges 362, 372 may be welded or otherwise mechanically fixed together.

In the illustrated embodiment, the ground flanges 362, 372 are both bent in from the ground slats 360, 370 above the corresponding pair 386 of receptacle signal contacts 162. Alternatively, the ground flange 362 may be bent in from the top of the ground slat 360 while the ground flange 372 may be bent in from the bottom of the ground slat 370, or vice versa.

The receptacle signal contacts 162 have broadsides 394 and edgesides 396. The broadsides 394 are wider than the edgesides 396. The edgesides 396 may be cut sides of the receptacle signal contacts 162, such as in embodiments where the receptacle signal contacts 162 are stamped and formed. The edgesides 396 oppose edgesides 396 of other receptacle signal contacts 162. The broadsides 394 face outward toward the first and second sides 382, 384 of the dielectric body 380. The ground slats 360, 370 extend along, parallel to and spaced apart from, the broadsides 394. The ground flanges 362, 372 extend between edgesides 396 of receptacle signal contacts 162 of adjacent pairs 386. No portions of the ground inlays 350, 352 extend between edgesides 396 of the receptacle signal contacts 162 of the same pair 386.

The contact module 160 provides electrical shielding for the pairs 386 of receptacle signal contacts 162 by way of the internal ground inlays 350, 352. The ground inlays 350, 352 provide shielding along sides of the receptacle signal contacts 162 as well as between pairs of the receptacle signal contacts 162 via the ground flanges 362, 372. Use of the ground inlays 350, 352 to provide shielding reduces overall cost of the contact module 160 and receptacle assembly 152 as compared to contact modules 160 that have conductive holders (e.g. die cast or metallized plastic) providing electrical shielding for the pairs of receptacle signal contacts 162.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A contact module for a receptacle assembly, the contact module comprising:

a tray having a cavity defined by inner surfaces of the tray, the tray having a mating end and a mounting end;

ground inlays received in the cavity along corresponding inner surfaces, the ground inlays having grounding beams extending exterior of the cavity beyond the mating end of the tray, the grounding beams being configured to engage a grounded component, the ground inlays having grounding posts exterior of the cavity beyond the mounting end of the tray, the grounding posts being configured to engage a grounded component, the ground inlays having ground slats extending between the grounding beams and the grounding posts, the ground inlays having ground flanges extending from the ground slats; and a frame assembly received in the cavity of the tray between the ground inlays, the frame assembly being electrically shielded by the ground inlays, the frame assembly having a plurality of receptacle signal contacts, the receptacle signal contacts having mating portions extending exterior of the cavity from the mating end of the tray, the receptacle signal contacts being arranged in differential pairs carrying differential signals;

wherein the ground slats extend along opposite sides of corresponding pairs of the receptacle signal contacts and wherein the ground flanges extend between pairs of the receptacle signal contacts.

2. The contact module of claim 1, wherein the ground flanges extend generally perpendicular from the ground slats.

3. The contact module of claim 1, wherein the receptacle signal contacts have edgesides and broadsides, the broadsides being wider than the edgesides, the edgesides facing other receptacle signal contacts, the ground slats extending along, parallel to and spaced apart from, the broadsides, the ground flanges extending between edgesides of receptacle signal contacts of adjacent pairs.

4. The contact module of claim 1, wherein the tray is manufactured from plastic, the ground inlays providing electrical shielding for the pairs of receptacle signal contacts.

5. The contact module of claim 1, wherein the ground inlays and frame assembly are interior of the tray, the tray having first and second opposite side walls exterior of the ground inlays and frame assembly.

6. The contact module of claim 1, wherein the ground inlays are on opposite sides of the frame assembly, the ground flanges of the ground inlays on opposite sides of the frame assembly overlapping each other.

7. The contact module of claim 1, wherein the receptacle signal contacts extend along a signal contact plane, the ground flanges extend through the signal contact plane.

8. The contact module of claim 1, wherein the frame assembly comprises a dielectric body holding the receptacle signal contacts, the dielectric body having a first side and a second side, the ground slats extending along the first and second sides of the dielectric body, the ground flanges extending into the dielectric body interior of the first and second sides.

9. A receptacle assembly comprising:

a receptacle housing; and a plurality of contact modules arranged in the housing in a stacked configuration, each contact module comprising:

a tray having a cavity defined by inner surfaces of the tray;

a frame assembly received in the cavity of the tray, the frame assembly having a dielectric body holding a plurality of receptacle signal contacts arranged in differential pairs carrying differential signals; and ground inlays received in the cavity between corresponding inner surfaces and the dielectric body of the frame assembly, the ground inlays having a main body including ground slats and ground flanges extending from the ground slats, wherein the ground flanges extend into the dielectric body and are positioned between differential pairs of the receptacle signal contacts.

10. The receptacle assembly of claim 9, wherein the ground flanges extend generally perpendicular from the ground slats.

11. The receptacle assembly of claim 9, wherein the receptacle signal contacts have edgesides and broadsides, the broadsides being wider than the edgesides, the edgesides facing other receptacle signal contacts, the ground slats extending along, parallel to and spaced apart from, the broadsides, the ground flanges extending between edgesides of receptacle signal contacts of adjacent pairs.

12. The receptacle assembly of claim 9, wherein the tray is manufactured from plastic, the ground inlays providing electrical shielding for the pairs of receptacle signal contacts.

13. The receptacle assembly of claim 9, wherein the ground inlays are on opposite sides of the frame assembly, the ground flanges of the ground inlays on opposite sides of the frame assembly overlapping each other.

14. The receptacle assembly of claim 9, wherein the receptacle signal contacts extend along a signal contact plane, the ground flanges extend through the signal contact plane.

15. A receptacle assembly comprising:

a receptacle housing having a mating end; and a contact module received in the housing, the contact module comprising:

a tray having a cavity defined by inner surfaces of the tray, the tray having a mating end and a mounting end;

ground inlays received in the cavity along corresponding inner surfaces, the ground inlays having grounding beams extending exterior of the cavity beyond the mating end of the tray, the grounding beams being configured to engage a grounded component, the ground inlays having grounding posts exterior of the cavity beyond the mounting end of the tray, the grounding posts being configured to engage a grounded component, the ground inlays having ground slats extending between the grounding beams and the grounding posts, the ground inlays having ground flanges extending from the ground slats; and a frame assembly received in the cavity of the tray between the ground inlays, the frame assembly being electrically shielded by the ground inlays, the frame assembly having a plurality of receptacle signal contacts, the receptacle signal contacts having mating portions extending exterior of the cavity from the mating end of the tray, the receptacle signal contacts being arranged in differential pairs carrying differential signals;

wherein the ground slats extend along opposite sides of corresponding pairs of the receptacle signal contacts and wherein the ground flanges extend between pairs of the receptacle signal contacts.

16. The receptacle assembly of claim 15, wherein the ground flanges extend generally perpendicular from the ground slats.

17. The receptacle assembly of claim 15, wherein the ground inlays are on opposite sides of the frame assembly, the ground flanges of the ground inlays on opposite sides of the frame assembly overlapping each other.

18. The receptacle assembly of claim 15, wherein the receptacle signal contacts extend along a signal contact plane, the ground flanges extend through the signal contact plane.

19. The receptacle assembly of claim 15, wherein the frame assembly comprises a dielectric body holding the receptacle signal contacts, the dielectric body having a first side and a second side, the ground slats extending along the first and second sides of the dielectric body, the ground flanges extending into the dielectric body interior of the first and second sides.

20. The receptacle assembly of claim 15, wherein the receptacle housing holds a plurality of contact modules in a stacked configuration side-by-side, the ground slats being positioned between receptacle signal contacts held in different contact modules, the ground flanges being posited between receptacle signal contacts within the respective contact module.

* * * * *